US006499978B2

(12) United States Patent
Cho et al.

(10) Patent No.: US 6,499,978 B2
(45) Date of Patent: Dec. 31, 2002

(54) SCROLL COMPRESSOR HAVING DIFFERENT WRAP THICKNESSES

(75) Inventors: Yang Hee Cho, Seoul (KR); Young Il Chang, Seoul (KR); Byeong Chul Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/832,819

(22) Filed: Apr. 12, 2001

(65) Prior Publication Data

US 2002/0048522 A1 Apr. 25, 2002

(30) Foreign Application Priority Data

Oct. 23, 2000 (KR) ..... 00-62286
Oct. 25, 2000 (KR) ..... 00-62957

(51) Int. Cl.[7] ..... F04C 18/04
(52) U.S. Cl. ..... 418/55.2
(58) Field of Search ..... 418/55.2

(56) References Cited

U.S. PATENT DOCUMENTS 3,473,728 A * 10/1969 Vulliez ..... 418/55.2
5,059,102 A * 10/1991 Tokumitsu et al. ..... 418/55.2
5,318,424 A * 6/1994 Bush et al. ..... 418/55.2

FOREIGN PATENT DOCUMENTS

| | | | | |
|---|---|---|---|---|
| DE | 1628418 | * | 7/1977 | 418/55.2 |
| JP | 58-172405 | * | 10/1983 | 418/55.2 |
| JP | 60-98185 | * | 6/1985 | 418/55.2 |
| JP | 61-265376 | * | 11/1986 | 418/55.2 |
| JP | 1-63682 | * | 3/1989 | 418/55.2 |
| JP | 1-211601 | * | 8/1989 | 418/55.2 |
| JP | 6-10857 | * | 1/1994 | 418/55.2 |

* cited by examiner

*Primary Examiner*—John J. Vrablik
(74) *Attorney, Agent, or Firm*—Birch, Stewart, Kolasch & Birch, LLP

(57) ABSTRACT

A scroll compressor is disclosed. In the scroll compressor of this invention, the involute fixed and orbiting scroll wraps engage with each other to form a plurality of variable compression chambers between them. In the compressor, at least one of the involute fixed and orbiting scroll wraps is formed at a middle section thereof to be thicker than the other sections. Therefore, it is possible for the fixed and orbiting scroll wraps to engage with each other without forming a gap at the central portion of the compression part, thus minimizing a leakage of compressed gas refrigerant during a gas refrigerant compressing process of the scroll compressor. The scroll compressor of this invention is thus improved in its gas refrigerant compression efficiency, and is reduced in its operational noises.

8 Claims, 8 Drawing Sheets

SCROLL COMPRESSOR HAVING DIFFERENT WRAP THICKNESSES

BACKGROUND OF THE INVENTION

1. Field of the Invention

The present invention relates to scroll compressors and, more particularly, to a scroll compressor provided with a scroll wrap designed at a predetermined section to be different from the other sections in thickness, thus being improved in its gas refrigerant compression efficiency.

2. Description of the Prior Art

FIG. 1 is a sectional view of a conventional scroll compressor. FIG. 2 is a plan sectional view, showing the profile of the wraps of the fixed and orbiting scrolls of a conventional symmetric scroll compressor.

As shown in the drawings, the conventional symmetric scroll compressor has a main frame 20 and a sub-frame 25, which are set within a hermetic casing 1 at upper and lower positions. In such a conventional symmetric scroll compressor, a compression part 10, used for compressing gas refrigerant prior to discharging the compressed gas refrigerant, is set on the main frame 20 within the casing 1. A motor 30 is set within the space defined between the main frame 20 and the sub-frame 25, and is used for driving the compression part 10.

The above motor 30 comprises a stator 31 and a rotor 33, while the compression part 10 comprises a fixed scroll 11 and a orbiting scroll 15. The fixed and orbiting scrolls 11 and 15 have involute wraps 11*a* and 15*a*, with a phase difference of 180° formed between the two wraps 11*a* and 15*a*, The two wraps 11*a* and 15*a* of the scrolls 11 and 15 engage with each other to form variable compression chambers C and C' between them.

When the stator 31 of the motor 30 is turned on, the rotor 33 is rotated along with the motor shaft 35, and so the orbiting scroll 15 is orbited relative to the fixed scroll 11.

When the orbiting scroll 15 is orbited relative to the fixed scroll 11 as described above, the variable compression chambers C and C' formed between the two wraps 11*a* and 15*a* of the scrolls 11 and 15 are gradually reduced in their volumes and are increased in their pressures in a direction toward the center of the compression part 10. Therefore, it is possible to compress the gas refrigerant introduced into the compression part 10 through an inlet port 16 and to discharge the compressed gas refrigerant from the compression part 10 into a refrigerant discharging pipe through an outlet port 19. Such a gas refrigerant compressing process of the conventional symmetric scroll compressor is shown in FIG. 4 in detail.

In order to minimize a loss during the gas refrigerant compressing process, it is necessary to prevent a leakage of compressed gas refrigerant. In the conventional symmetric scroll compressor, the compressed gas refrigerant may leak in a radial direction through axial gaps and leak in a tangential direction through radial gaps.

Such a tangential leakage of compressed gas refrigerant through radial gaps is caused by the gaps formed between the two wraps 11*a* and 15*a* at a plurality of tangential contact points P of the two scrolls 11 and 15.

FIG. 3 is a view, showing the design factors of a conventionally designed scroll of the conventional symmetric scroll compressor.

As shown in the drawing, the wrap 11*a* or 15*a* of each of the fixed and orbiting scrolls 11 and 15 of the conventional symmetric scroll compressor is shaped as an involute curve, comprising an inside involute and an outside involute designed to have a phase difference of $\pm\alpha$ between them. Each of the wraps 11*a* and 15*a* also has a constant thickness T.

That is, the thickness T of each wrap 11*a* or 15*a* is expressed as follows: $T=L_0-L_i=a(\theta+\alpha)-a(\theta-\alpha)=2a\alpha$. This means that each wrap 11*a* or 15*a* has a constant thickness T from the first to the last.

However, such a conventional symmetric scroll compressor is problematic due to the constant thickness of the wraps 11*a* and 15*a*, That is, since the wraps 11*a* and 15*a* of the fixed and orbiting scrolls 11 and 15 of the conventional symmetric scroll compressor have such a constant thickness T as described above, a plurality of gaps are undesirably formed between the two wraps 11*a* and 15*a* at the tangential contact points P of the two scrolls 11 and 15 as shown in FIG. 2 due to a requirement of machining allowance and/or assembling allowance of the two wraps 11*a* and 15*a*. In addition, the size of such gaps is not uniform, and so the amounts of leaking gas refrigerant from the compression chambers C and C' of the compression part 10 are different from each other. This finally causes a reduction in the gas refrigerant compression efficiency and an increase in operational noises of such a conventional symmetric scroll compressor.

If the profile of each wrap 11*a* or 15*a* of the two scrolls 11 and 15 is shaped as an ideal involute curve, it is possible to allow the tangential contact points P of the two scroll wraps 11*a* and 15*a* to be completely free from such undesired gaps or to have only negligible gaps. In such a case, the symmetric scroll compressor accomplishes desired gas refrigerant compression efficiency. However, it is practically impossible to form such an ideal involute curve in the scroll wraps 11*a* and 15*a* due to a requirement of machining allowance and/or assembling allowance of the two wraps 11*a* and 15*a*, Therefore, a plurality of gaps having different sizes are formed at the tangential contact points P of the two scroll wraps 11*a* and 15*a*, thereby undesirably allowing a leakage of compressed gas refrigerant. This results in a reduction in the gas refrigerant compression efficiency and an increase in operational noises of the conventional symmetric scroll compressors.

FIG. 5 is a plan sectional view, showing the profile of the wraps of the fixed and orbiting scrolls of a conventional asymmetric scroll compressor.

As shown in the drawings, the conventional asymmetric scroll compressor is designed such that the involute terminal angle $\phi e'$ of the fixed scroll wrap 15' is larger than the involute terminal angle $\phi e$ of the orbiting scroll wrap 11' at an angle of 180°, with a plurality of variable compression chambers formed between the two scroll wraps 11' and 15'. This asymmetric scroll compressor is preferably increased in the volume of its sucked gas refrigerant by at least 10% in comparison with the conventional symmetric scroll compressor without changing the inner diameters of the main and sub-frames.

In such scroll compressors, the term "involute terminal angle of a scroll wrap" means an angle formed between the initial end and the terminal end of the scroll wrap.

Different from the conventional symmetric scroll compressor, the conventional asymmetric scroll compressor has only one gas refrigerant suction part, and so the asymmetric scroll compressor does not have any gas refrigerant suction passage formed around the outer edge of the orbiting scroll. Therefore, this asymmetric scroll compressor is less likely to overheat the sucked gas refrigerant, and is improved in its volume efficiency in comparison with the symmetric scroll compressor. The asymmetric scroll compressor is thus allowed to gradually and smoothly suck gas refrigerant into its compression part, and is remarkably reduced in its pulse vibration in comparison with the symmetric scroll compressor when the compressed air refrigerant is discharged from the compressor.

However, the conventional asymmetric scroll compressor is problematic as follows. That is, the asymmetric scroll compressor uses the extended inside involute section $\phi e \sim \phi e'$ of the fixed scroll wrap 11' as a compression chamber different from the conventional symmetric scroll compressor which does not use such an inside involute section $\phi e \sim \phi e'$ as the compression chamber. In addition, the fixed and orbiting scrolls of the asymmetric scroll compressor are designed such that the involute terminal angle $\phi e'$ of the fixed scroll wrap 15' is larger than that of the orbiting scroll wrap 11' at an angle of 180° different from the conventional symmetric scroll compressor. Therefore, the number of gaps allowing a leakage of compressed gas refrigerant is undesirably increased in the asymmetric scroll compressor.

FIG. 6 is a view, showing the profile of a scroll wrap of the conventional asymmetric scroll compressor having a dimensional error caused by both machining allowance and assembling allowance. When the orbiting scroll wrap 11' is not shaped as an ideal involute curve, but has a dimensional error due to the machining allowance and the assembling allowance as shown in FIG. 6, it is fortunately possible to prevent a leakage of compressed gas refrigerant at the outermost contact point $\delta_0$ (see FIG. 7) having a low pressure difference since the fixed scroll wrap 11' comes into close contact with the orbiting scroll wrap 15'. However, it is almost impossible to prevent a formation of gaps at the inside contact points $\delta_1$ and $\delta_2$ (see FIG. 7), and so compressed gas refrigerant undesirably leaks through the gaps at the inside contact points $\delta_1$ and $\delta_2$. Since the pressure difference at the inside contact points $\delta_1$ and $\delta_2$ is so high that the leakage of the compressed gas refrigerant at said points $\delta_1$ and $\delta_2$ seriously influences the compression efficiency of the compressor, the asymmetric scroll compressor is undesirably reduced in its compression efficiency.

In addition, such a conventional asymmetric scroll compressor is designed such that the sealing structure of the compressor for preventing a radial leakage of compressed gas refrigerant is formed by biasing the orbiting scroll wrap 15' toward the fixed scroll wrap 11'. However, this structure undesirably causes imbalance at the contact points $\delta_0$, $\delta_1$ and $\delta_2$ due to dimensional error caused by the machining allowance and the assembling allowance, thus finally impacting the two scroll wraps 11' and 15' at the contact points between them and generating operational noises of the compressor.

SUMMARY OF THE INVENTION

Accordingly, the present invention has been made keeping in mind the above problems occurring in the prior art, and an object of the present invention is to provide a scroll compressor, of which at least one of fixed and orbiting scroll wraps is formed at a predetermined section thereof to be different from the other sections in thickness, and which is thus improved in its gas refrigerant compression efficiency and is reduced in its operational noises.

In order to accomplish the above object, the present invention provides a scroll compressor, comprising fixed and orbiting scrolls having involute wraps, the involute fixed and orbiting scroll wraps engaging with each other to form a plurality of variable compression chambers between them, wherein at least one of the involute fixed and orbiting scroll wraps is formed at a predetermined section thereof to be thicker than the other sections.

In an embodiment, the present invention provides a scroll compressor, comprising fixed and orbiting scrolls having involute wraps, the involute fixed and orbiting scroll wraps engaging with each other to form a plurality of variable compression chambers between them, wherein at least one of the involute fixed and orbiting scroll wraps is formed at a middle section thereof to be thicker than a terminal section.

In the above scroll compressor, the middle section of at least one of the involute fixed and orbiting scroll wraps extends from a point having an angle of $\phi e - 4\pi$ to another point having an angle of $\phi e - 2\pi$, with the involute terminal angle of the wrap formed from the initial end to the terminal end of the wrap being designated by $\phi e$.

In another embodiment, the present invention provides an asymmetric scroll compressor, comprising fixed and orbiting scrolls having involute wraps, with the involute terminal angle $\phi e'$ of the fixed scroll wrap being larger than the involute terminal angle $\phi e$ of the orbiting scroll wrap by a predetermined angle, thus forming an extension part $\phi e \sim \phi e'$, wherein the involute fixed scroll wrap is offset at the inside surface of the extension part by a predetermined thickness, thus forming a gap between the fixed and orbiting scroll wraps at the extension part.

In a further embodiment, the present invention provides an asymmetric scroll compressor, comprising fixed and orbiting scrolls having involute wraps, with the involute terminal angle $\phi e'$ of the fixed scroll wrap being larger than the involute terminal angle $\phi e$ of the orbiting scroll wrap by a predetermined angle, thus forming an extension part $\phi e \sim \phi e'$, wherein the orbiting scroll wrap is offset at its outside surface at a portion corresponding to the extension part of the fixed scroll wrap by a predetermined thickness, thus forming a gap between the fixed and orbiting scroll wraps at the extension part.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 8:
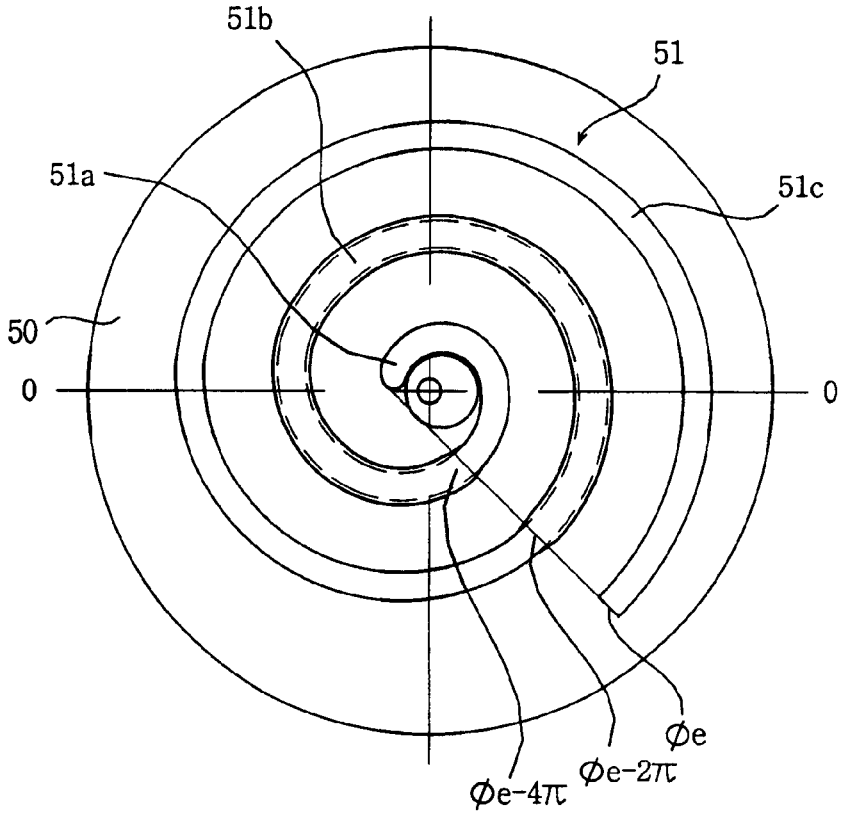
FIG. 8 is a plan view, showing the profile of a scroll of a symmetric scroll compressor in accordance with the primary embodiment of the present invention.

FIG. 8 is a plan view, showing the profile of a scroll of a symmetric scroll compressor in accordance with the primary embodiment of the present invention.

In FIG. 8, the orbiting scroll 50 of the compressor is shown as an example. As shown in the drawing, the involute scroll wrap is sectioned into three parts: that is, an initial section extending from the initial end "O" to a predetermined first point of the involute wrap, a middle section extending from the first point to a predetermined second point, and a terminal section extending from the second point to the terminal end of the involute wrap. In the preferred embodiment of FIG. 8, the orbiting scroll wrap 51 is designed such that its middle section 51*b* is thicker than the other sections 51*a* and 51*c*.

In the scroll compressor of this invention, the involute terminal angle of the orbiting scroll wrap 51, formed from the initial end "O" to the terminal end of the involute wrap 51, is designated by the reference character "$\phi e$".

In such a case, the initial section 51*a* of the scroll wrap 51 extends from the initial end "O" to a first point having an involute angle of $\phi e-4\pi$. In the same manner, the middle section 51*b* of the wrap 51 extends from the first point of $\phi e-4\pi$ to a second point having an angle of $\phi e-2\pi$, while the terminal section 51*c* of the wrap 51 extends from the second point of $\phi e-2\pi$ to the terminal end having the involute angle of $\phi e$.

In the above embodiment, the scroll wrap 51 is preferably designed such that the middle section 51*b* extending from the first point of $\phi e-4\pi$ to the second point of $\phi e-2\pi$ is thicker than the other sections 51*a* and 51*c* by 20 $\mu$m~50 $\mu$m.

Of course, it should be understood that the same operational effect of the present invention may be obtained by designing the fixed scroll wrap in place of the orbiting scroll wrap 51 such that the middle section of said fixed scroll wrap is thicker than the other sections.

In the present invention, such a middle section of the orbiting scroll wrap or the fixed scroll wrap, which is thicker than the other sections of the scroll wrap, may be accomplished by making both the inside and outside surfaces of said middle section thicker than the other sections. Alternatively, the thicker middle section of the orbiting scroll wrap or the fixed scroll wrap may be accomplished by making the inside or outside surface of the scroll wrap thicker than the other sections.

As a further alternative, the same operational effect of the present invention may be accomplished by making the outside surface of the middle section of the fixed scroll wrap thicker than the other sections and by making the inside surface of the middle section of the orbiting scroll wrap thicker than the other sections. It is also possible to accomplish the same operational effect of the present invention by making the inside surface of the middle section of the fixed scroll wrap thicker than the other sections and by making the outside surface of the middle section of the orbiting scroll wrap thicker than the other sections.

In the present invention, it is preferable to make the middle section of the scroll wrap thicker than the other sections by 20 $\mu$m~50 $\mu$m because of the following concerns. That is, the machining allowance of conventional scroll compressors is set to about ±10 $\mu$m, and so the maximum allowance of the scroll wraps when the fixed and orbiting scroll wraps engage with each other becomes about 20 $\mu$m. The practical maximum allowance of the scroll wraps when considering the assembling allowance in addition to the machining allowance becomes larger than 20 $\mu$m.

Therefore, it is preferable to make the middle section of the scroll wrap thicker than the other sections by at least 20 $\mu$m. When the middle section of the scroll wrap is excessively thicker than the other sections, the gaps at the contact points within the other sections are undesirably enlarged. It is thus necessary to limit the maximum thickness difference between the middle section of the scroll wrap and the other sections to 50 $\mu$m. Therefore, the middle section of the scroll wrap is preferably designed to be thicker than the other sections by 20 $\mu$m~50 $\mu$m.

In the above embodiment, the middle section of the scroll wrap is designed to be thicker than the initial and terminal sections. However, it should be understood that the same operational effect of the present invention may be accomplished by making both the initial and middle sections of the scroll wrap thicker than the terminal section.

The operational effect of the above-mentioned scroll compressor of this invention will be described herein below.

Figure 1:
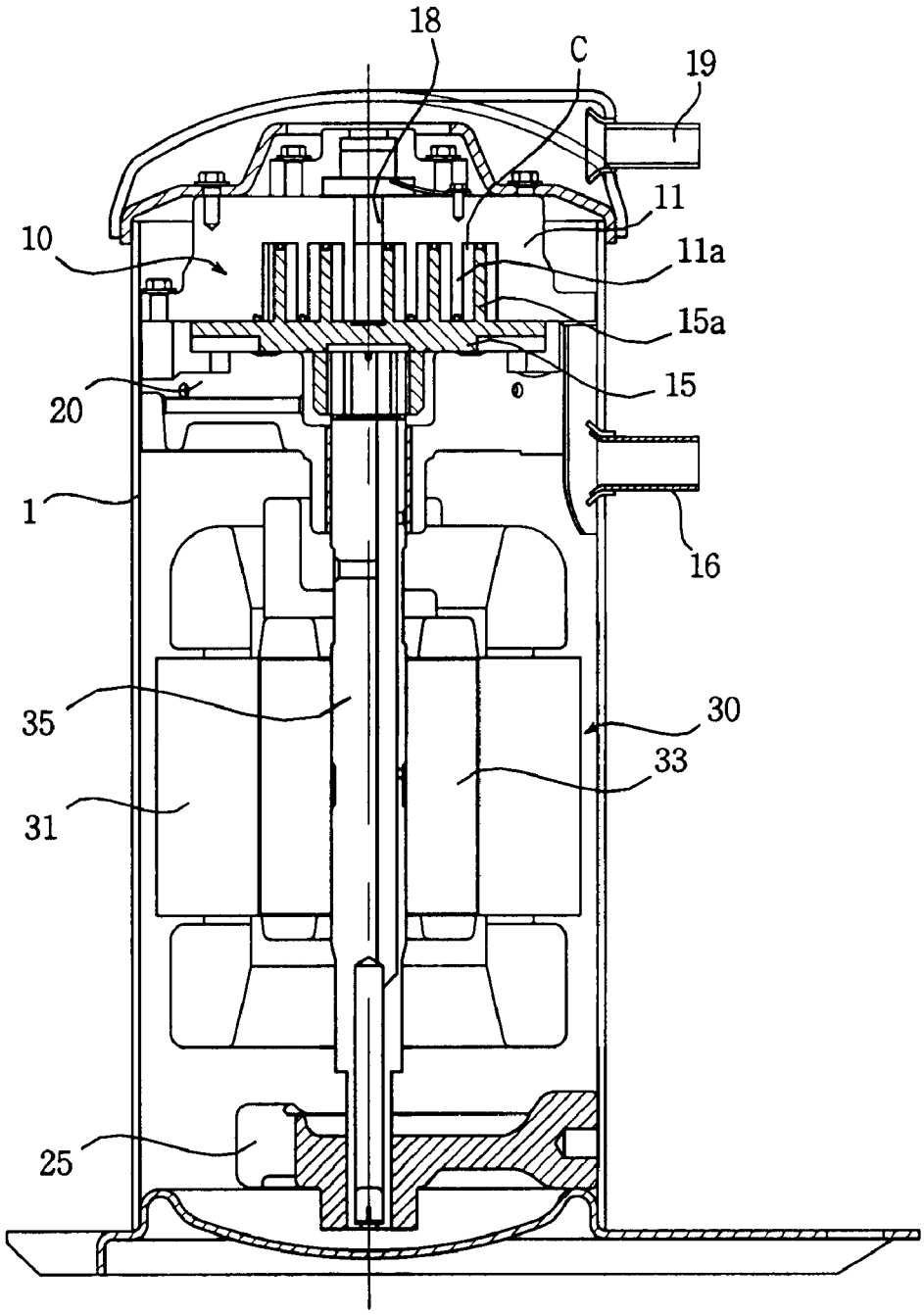
FIG.1 (Prior Art)
FIG. 1 is a sectional view of a conventional scroll compressor.
Figure 2:
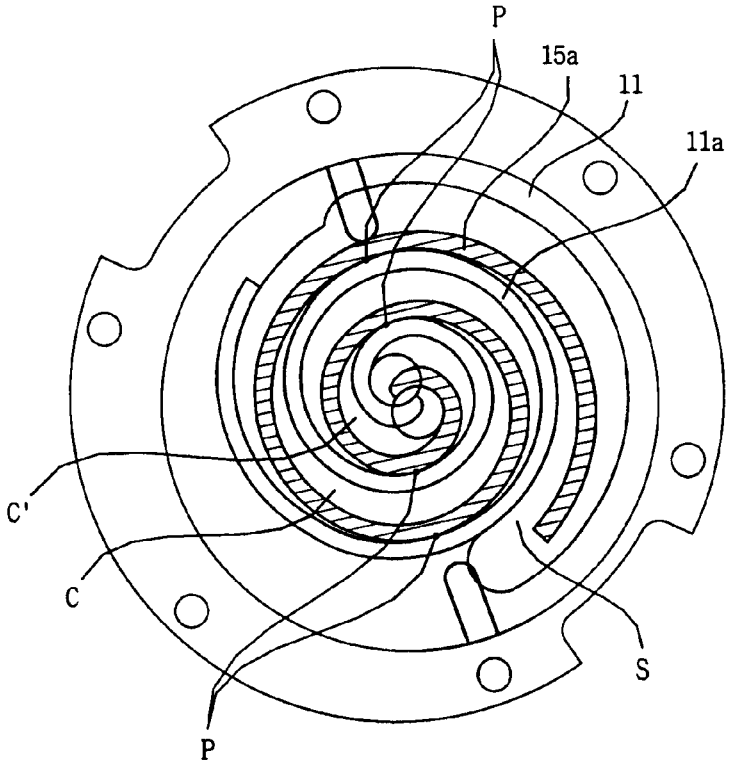
FIG.2 (Prior Art)
FIG. 2 is a plan sectional view, showing the profile of the wraps of fixed and orbiting scrolls of a conventional symmetric scroll compressor.
Figure 3:
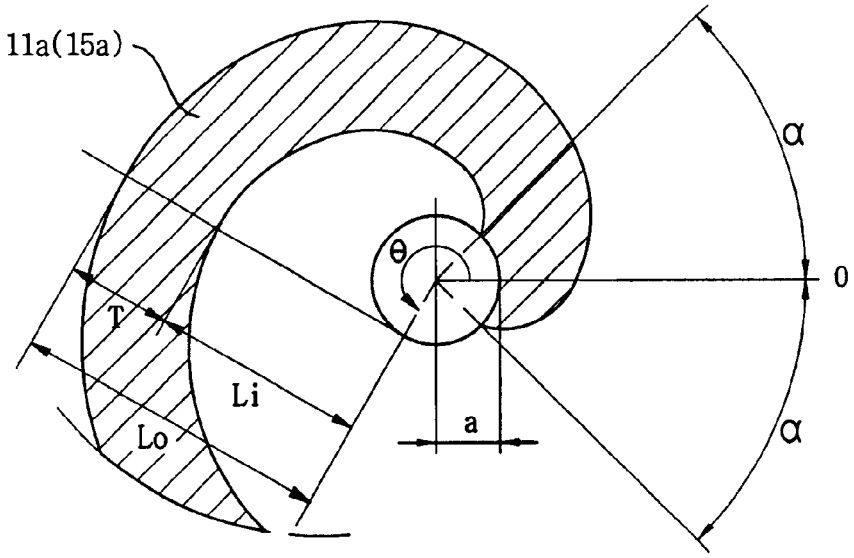
FIG.3 (Prior Art)
FIG. 3 is a view, showing the designing factors of a conventionally designed scroll of the conventional symmetric scroll compressor.
Figure 4:
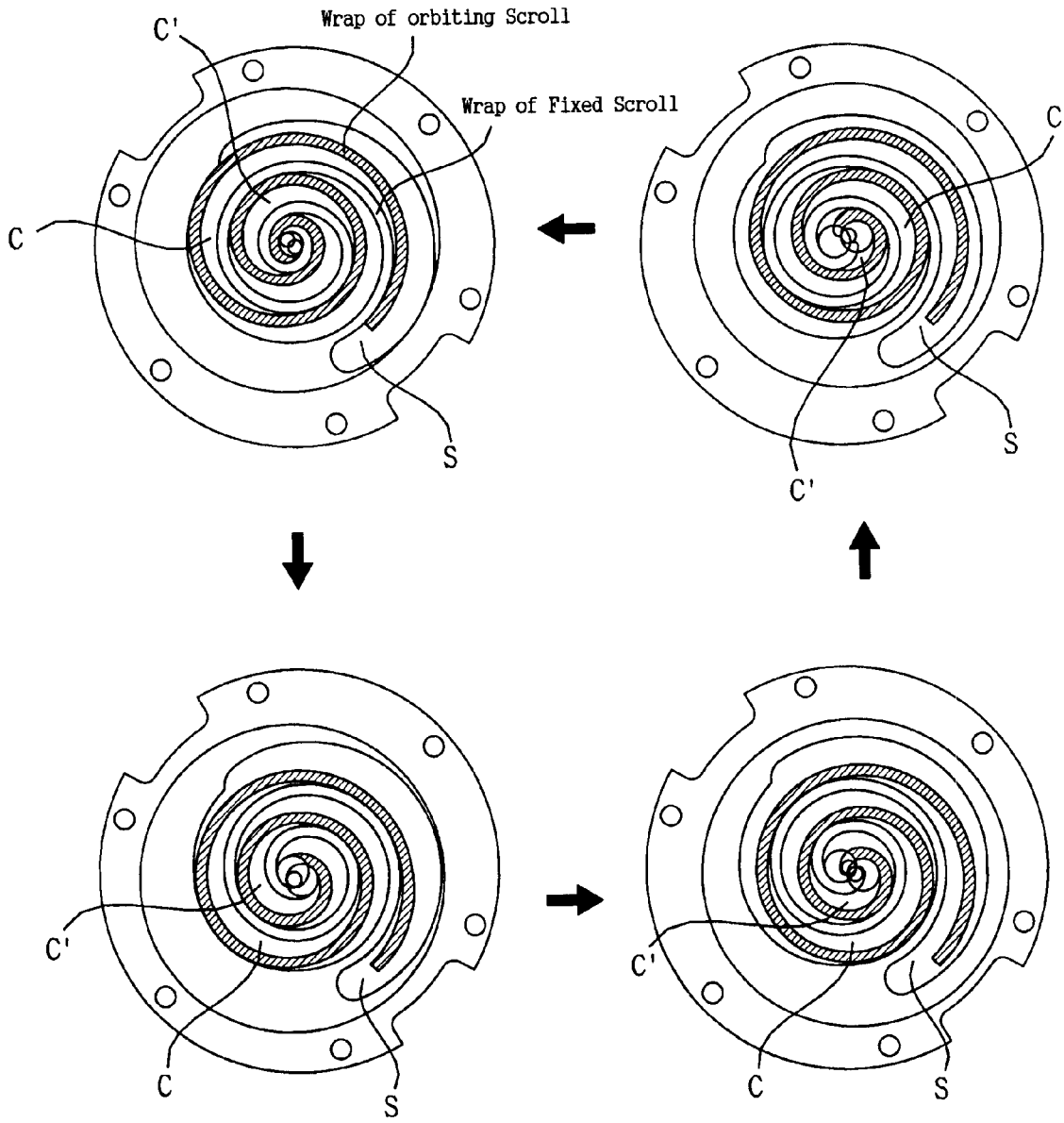
FIG.4 (Prior Art)
FIG. 4 is a view, showing a gas refrigerant compressing process of the conventional symmetric scroll compressor.
Figure 5:
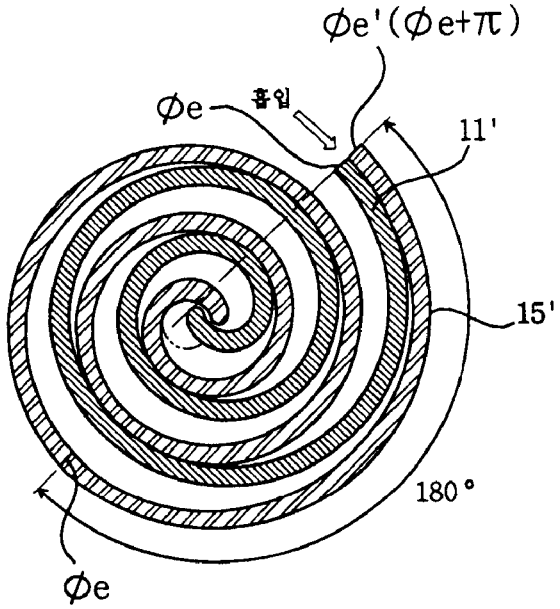
FIG.5 (Prior Art)
FIG. 5 is a plan sectional view, showing the profile of the wraps of fixed and orbiting scrolls of a conventional asymmetric scroll compressor.
Figure 6:
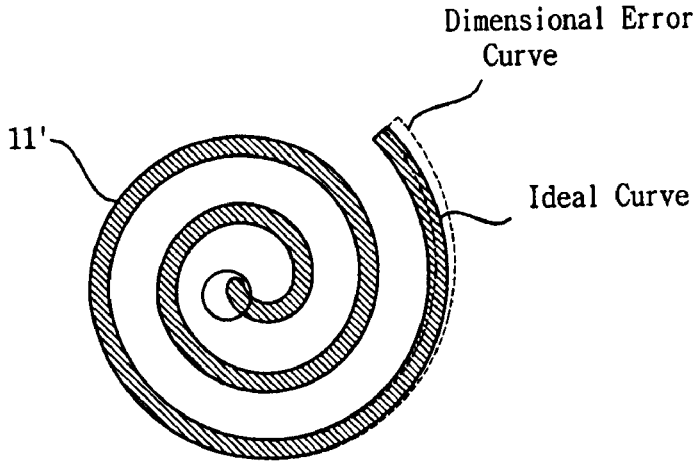
FIG.6 (Prior Art)
FIG. 6 is a view, showing the profile of a scroll wrap of the conventional asymmetric scroll compressor having a dimensional error caused by both machining allowance and assembling allowance.
Figure 7:
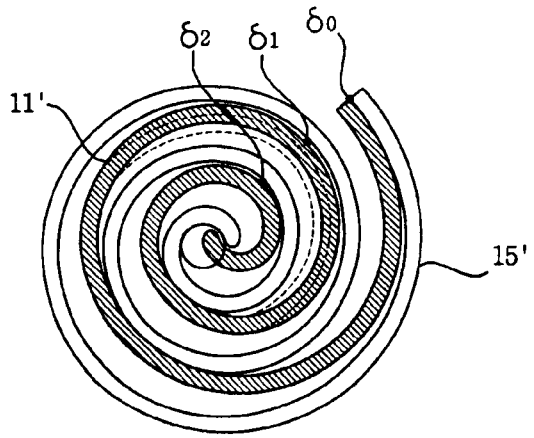
FIG.7 (Prior Art)
FIG. 7 is a view, showing the gaps formed between the fixed and orbiting scroll wraps of the conventional asymmetric scroll compressor due to the dimensional error caused by both machining allowance and assembling allowance.

In an operation of a conventional scroll compressor of FIG. 4, compressed gas refrigerant may leak from the compression chambers of the compression part in a radial direction through the junction of the first compression chamber C and the suction part S and the junction of the first and second compression chambers C and C'.

Of the two types of radial leakage of compressed gas refrigerant, the first radial leakage, occurring at the junction of the first compression chamber C and the suction part S provided at the outside portion of the fixed and orbiting scrolls, is typically created at the initial stage of the compression process. Therefore, this first radial leakage of compressed gas refrigerant is less likely to cause an increase in pressure within the compressor, but slightly reduces the amount of inlet gas refrigerant introduced into the compression chamber C.

Meanwhile, the second radial leakage, occurring at the junction of the first and second compression chambers C and C' provided at the inside portion of the fixed and orbiting scrolls, is created within the compression chambers. Therefore, this second radial leakage of compressed gas refrigerant increases the temperature and pressure of the compressor since it is necessary to recompress the gas refrigerant. This finally reduces compression efficiency. That is, the compression efficiency of the scroll compressor is mainly influenced by the second radial leakage of compressed gas refrigerant rather than the first radial leakage.

However, in the scroll compressor of the present invention, the middle section of the scroll wrap is designed to be thicker than the initial and terminal sections as described above. Therefore, the contact points of the fixed and orbiting scroll wraps within the middle section are always kept in their contact positions, thus reliably forming the desired compression chambers and accomplishing a desired compression process within the compression chambers.

That is, the fixed and orbiting scroll wraps always come into close contact with each other at the contact points around the first and second compression chambers C and C' within the middle section during an operation of the scroll compressor, thus minimizing the leakage of compressed gas refrigerant at the central portion of the scroll compressor and improving the compression efficiency of the compressor.

FIGS. 9*a* to 11 are views, showing the profile of the wraps of fixed and orbiting scrolls of asymmetric scroll compressors in accordance with the second, third and fourth embodiments of the present invention.

Figure 9A:
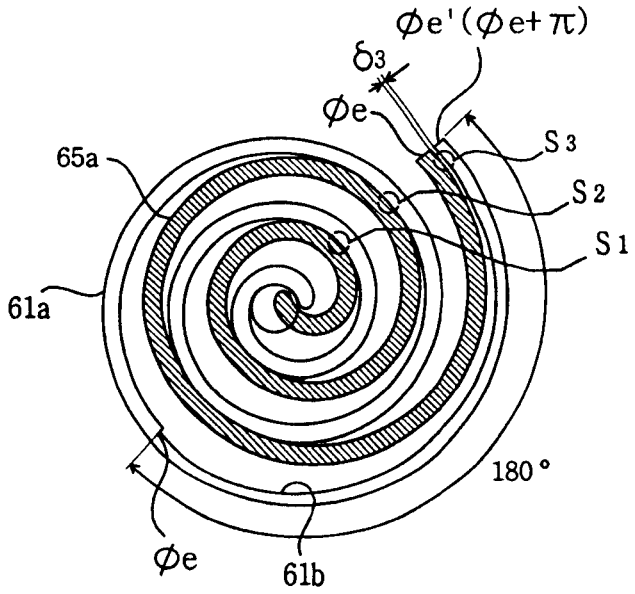
FIG. 9*a* is a plan sectional view, showing the profile of the wraps of fixed and orbiting scrolls of an asymmetric scroll compressor in accordance with the second embodiment of the present invention.

In the asymmetric scroll compressor in accordance with the second embodiment of the present invention, the fixed and orbiting scrolls have involute wraps 61*a* and 65*a*, which engage with each other to form variable compression chambers between them as shown in FIG. 9*a*. This asymmetric scroll compressor is designed such that the involute terminal angle $\phi e'$ of the fixed scroll wrap 61*a* is larger than the involute terminal angle $\phi e$ of the orbiting scroll wrap 65*a* by an angle of $180°\pi$.

In the asymmetric scroll compressor of FIG. 9*a*, the involute terminal angle $\phi e'$ of the fixed scroll wrap 61*a* is an angle formed between the initial end and the terminal end of the fixed scroll wrap 61*a*. In the same manner, the involute terminal angle $\phi e$ of the orbiting scroll wrap 65*a* is an angle formed between the initial end and the terminal end of the fixed scroll wrap 65*a*.

In the above asymmetric scroll compressor, the involute terminal angle $\phi e'$ of the fixed scroll wrap 61*a* is larger than the involute terminal angle $\phi e$ of the orbiting scroll wrap 65*a* by an angle of 180°, and so the fixed scroll wrap 61*a* has an asymmetric extension part $\phi e \sim \phi e'$. A suction part is formed between the two scroll wraps 61*a* and 65*a* at the asymmetric extension part $\phi e \sim \phi e'$.

Figure 9B:
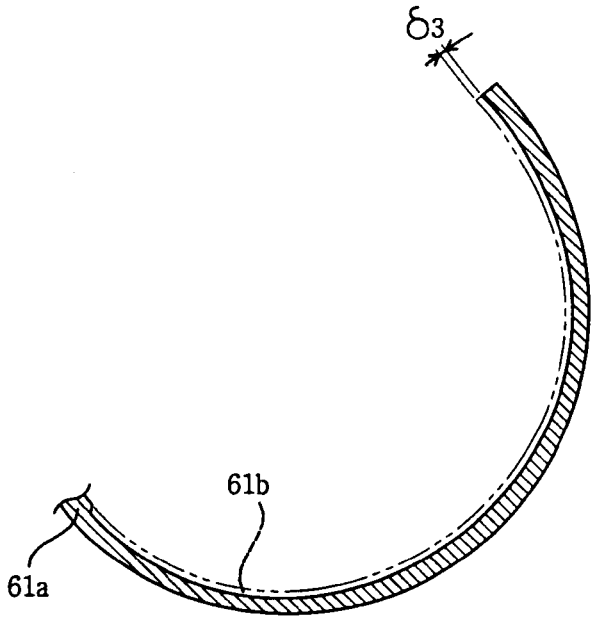
FIG. 9*b* is a view, showing a partially offset asymmetric extension part of the fixed scroll wrap of the scroll compressor of FIG. 9*a* in detail.

In addition, the inside surface of the asymmetric extension part $\phi e \sim \phi e'$ of the fixed scroll wrap 61*a* is offset by a predetermined thickness of $\delta_3$ as best seen in FIG. 9*b*, thus having an offset part 61*b*. Due to the offset part 61*b*, the asymmetric extension part $\phi e \sim \phi e'$ of the fixed scroll wrap 61*a* does not come into contact with the orbiting scroll wrap 65*a*, but forms a predetermined gap between the two scroll wraps 61*a* and 65*a* at the asymmetric extension part $\phi e \sim \phi e'$.

That is, the fixed scroll wrap 61*a* of the above asymmetric scroll compressor according to the second embodiment of this invention is designed such that the section having the offset part 61*b* is thinner than the other sections free from such an offset part 61*b*.

In such a case, it is preferable to offset the fixed scroll wrap 61*a* at the asymmetric extension part by a thickness of 20 $\mu$m~50 $\mu$m. In addition, it is possible to form the offset part 61*b* by totally offsetting the asymmetric extension part $\phi e \sim \phi e'$ of the fixed scroll wrap 61*a* or by partially offsetting the asymmetric extension part $\phi e \sim \phi e'$.

Due to the offset part 61*b* of the fixed scroll wrap 61*a*, the fixed scroll wrap 61*a* does not come into contact with the orbiting scroll wrap 65*a* at the outermost leakage point $S_3$ of the three leakage points $S_1$, $S_2$ and $S_3$, which is included in the asymmetric extension part of the fixed scroll wrap 61*a*, However, a predetermined gap is formed between the two scroll wraps 61*a* and 65*a* during a gas refrigerant process as shown in FIG. 9*a*.

That is, a gap having a thickness of $\delta_3$ is formed between the fixed and orbiting scroll wraps 61*a* and 65*a* at the outermost leakage point $S_3$ of the three leakage points $S_1$, $S_2$ and $S_3$. However, the two inside leakage points $S_1$ and $S_2$ of the three leakage points $S_1$, $S_2$ and $S_3$, of which the pressure differences are higher than that of the outermost leakage point $S_3$, are free from such a gap. The asymmetric scroll compressor according to the second embodiment of this invention is thus improved in its gas compression efficiency.

Figure 10A:
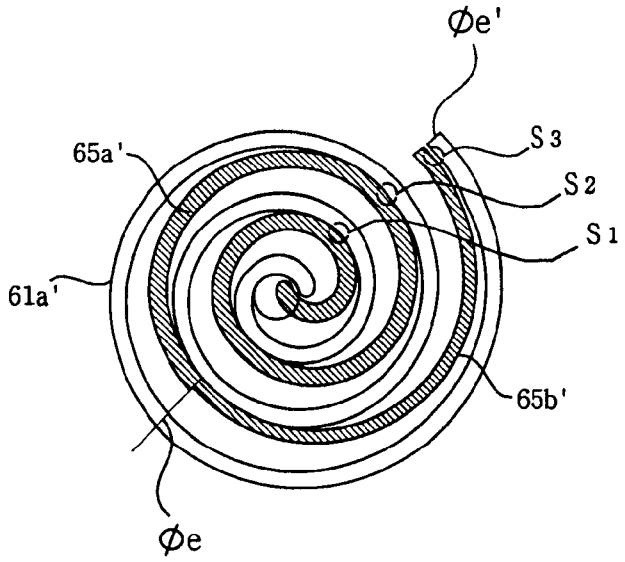
FIG. 10*a* is a plan sectional view, showing the profile of the wraps of fixed and orbiting scrolls of an asymmetric scroll compressor in accordance with the third embodiment of the present invention.
Figure 10B:
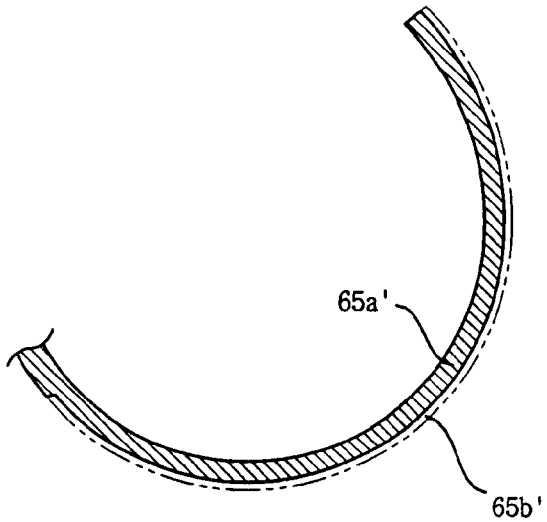
FIG. 10*b* is a view, showing a partially offset asymmetric extension part of the orbiting scroll wrap of the scroll compressor of FIG. 10*a* in detail.

FIGS. 10*a* and 10*b* are views, showing the fixed and orbiting scroll wraps of an asymmetric scroll compressor in accordance with the third embodiment of the present invention.

As shown in the drawings, the offset part 65*b*' according to the third embodiment of this invention is formed on the outside surface of the orbiting scroll wrap 65*a*' at a portion corresponding to the asymmetric extension part $\phi e \sim \phi e'$ of the fixed scroll wrap 61*a*' different from the second embodiment, of which the offset part is formed on the inside surface of the asymmetric extension part $\phi e \sim \phi e'$ of the fixed scroll wrap.

Since the outside surface of the orbiting scroll wrap 65*a*' according to the third embodiment is offset by a predetermined thickness to have the offset part 65*b*' as described above, the orbiting scroll wrap 65*a*' does not come into contact with the asymmetric extension part $\phi e \sim \phi e'$ of the fixed scroll wrap 61*a*', but forms a predetermined gap between the two scroll wraps 61*a*' and 65*a*' at the asymmetric extension part $\phi e \sim \phi e'$ in the same manner as that described for the second embodiment.

Due to the offset part 65*b*' of the orbiting scroll wrap 65*a*, the fixed and orbiting scroll wraps 61*a*' and 65*a*' do not come into contact with each other at the outermost leakage point $S_3$ of the three leakage points $S_1$, $S_2$ and $S_3$, which is included in the offset part 65*b*', in the same manner as that described for the second embodiment. Therefore, a gap is formed between the fixed and orbiting scroll wraps 61*a*' and 65*a*' at the outermost leakage point $S_3$, while the two inside leakage points $S_1$ and $S_2$, of which the pressure differences are higher than that of the outermost leakage point $S_3$, are free from such a gap. The asymmetric scroll compressor according to the third embodiment of this invention is thus improved in its gas compression efficiency.

Figure 11:
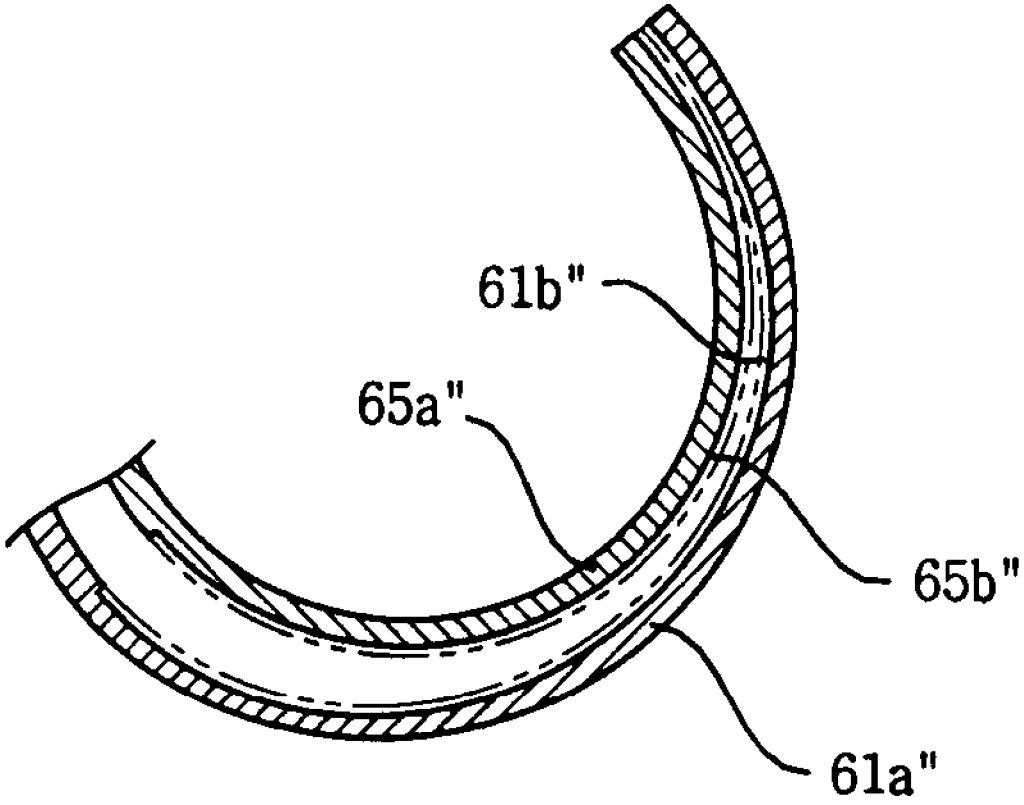
FIG. 11 is a plan sectional view, showing the profile of a part of the partially offset wraps of fixed and orbiting scrolls of an asymmetric scroll compressor in accordance with the fourth embodiment of the present invention.

FIG. 11 is a plan sectional view, showing the profile of a part of the partially offset wraps of fixed and orbiting scrolls of an asymmetric scroll compressor in accordance with the fourth embodiment of the present invention.

As shown in the drawing, the fixed and orbiting scroll wraps 61*a*" and 65*a*" according to this fourth embodiment are commonly offset at their facing surfaces at a portion corresponding to the asymmetric extension part of the fixed scroll wrap 61*a*", thus forming two offset parts 61*b*" and 65*b*" different from the second or third embodiment, of which one offset part is formed on either the inside surface of the fixed scroll wrap or the outside surface of the orbiting scroll wrap.

That is, the inside surface of the asymmetric extension part $\phi e \sim e'$ of the fixed scroll wrap 61*a*" is offset by a predetermined thickness, thus having a first offset part 61*b*", while the outside surface of the orbiting scroll wrap 65*a*" is offset by a predetermined thickness at a portion corresponding to the offset part 61*b*" of the fixed scroll wrap 61*a*", thus having a second offset part 65*b*". Therefore, the fixed and orbiting scroll wraps 61*a*" and 65*a*" do not come into contact with each other at the outermost leakage point $S_3$ of the three leakage points $S_1$, $S_2$ and $S_3$, but a gap is formed between the two scroll wraps 61*a*" and 65*a*" at the outermost leakage point $S_3$. However, the two inside leakage points $S_1$ and $S_2$, of which the pressure differences are higher than that of the outermost leakage point $S_3$, are free from such a gap. The asymmetric scroll compressor according to the fourth embodiment of this invention is thus improved in its gas compression efficiency.

As described above, the present invention provides a scroll compressor. In the scroll compressor of this invention, at least one of the fixed and orbiting scroll wraps is formed at a predetermined section to be thicker than the other sections thereof. Therefore, it is possible for the fixed and orbiting scroll wraps to engage with each other without forming a gap at the central portion of the compression part, thus minimizing a leakage of compressed gas refrigerant during a gas refrigerant compressing process of the scroll compressor. The scroll compressor of this invention is thus improved in its gas refrigerant compression efficiency, and is reduced in its operational noises.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A scroll compressor comprising:

a first scroll having first involute wrap; and a second scroll having second involute wrap, said first and second involute wraps engaging with each other during relative rotation to form a plurality of variable compression chambers therebetween, wherein said first and second involute wraps have respective initial ends and terminal ends, with the terminal end being located at an angle $\phi e$ relative to the initial end, each of said first and second involute wraps has an initial section defined between its respective initial end and an angle of $\phi e-4\pi$, a middle section defined between the angle of $\phi e-4\pi$ and an angle of $\phi e-2\pi$, and a terminal section defined between the angle of $\phi e-2\pi$ and said terminal end at the angle of $\phi e$;

wherein said middle section of said first involute wrap is thicker than said initial section and said terminal section of said first involute wrap; and wherein said first involute wrap is symmetrical to said second involute wrap excepting only that said middle section of said first involute wrap may have a thickness different than said middle section of said second involute wrap.

2. The scroll compressor according to claim 1, wherein said middle section of said first involute wrap is thicker than a thickness of said initial section and said terminal section of said first involute wrap by 20 $\mu$m~50 $\mu$m.

3. The scroll compressor according to claim 1, wherein said first scroll is an orbiting scroll and said first involute wrap is an orbiting scroll wrap; and wherein said second scroll is a fixed scroll and said second involute wrap is a fixed scroll wrap.

4. The scroll compressor according to claim 1, wherein said first scroll is a fixed scroll and said first involute wrap is fixed scroll wrap; and wherein said second scroll is an orbiting scroll and said second involute wrap is an orbiting scroll wrap.

5. The scroll compressor according to claim 4, wherein said middle section of said fixed scroll wrap is thicker at an outside surface as compared to said initial section and said terminal section of said fixed scroll wrap.

6. The scroll compressor according to claim 5, wherein said middle section of said orbiting scroll wrap is thicker at an inside surface as compared to said initial section and said terminal section of said orbiting scroll wrap.

7. The scroll compressor according to claim 4, wherein said middle section of said fixed scroll wrap is thicker at an inside surface as compared to said initial section and said terminal section of said fixed scroll wrap.

8. The scroll compressor according to claim 7, wherein said middle section of said orbiting scroll wrap is thicker at an outside surface as compared to said initial section and said terminal section of said orbiting scroll wrap.

* * * * *